US010504531B2

(12) United States Patent
Ramo et al.

(10) Patent No.: US 10,504,531 B2
(45) Date of Patent: Dec. 10, 2019

(54) AUDIO PARAMETER QUANTIZATION

(71) Applicant: Nokia Technologies Oy, Espoo (FI)

(72) Inventors: Anssi Ramo, Velholehde (FI); Adriana Vasilache, Tampere (FI); Lasse Juhani Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 151 days.

(21) Appl. No.: 15/506,416

(22) PCT Filed: Aug. 28, 2014

(86) PCT No.: PCT/FI2014/050658
§ 371 (c)(1),
(2) Date: Feb. 24, 2017

(87) PCT Pub. No.: WO2016/030568
PCT Pub. Date: Mar. 3, 2016

(65) Prior Publication Data
US 2018/0226082 A1 Aug. 9, 2018

(51) Int. Cl.
*G10L 19/032* (2013.01)
*G10L 19/04* (2013.01)
*G10L 19/008* (2013.01)

(52) U.S. Cl.
CPC ..... *G10L 19/032* (2013.01); *G10L 19/008* (2013.01); *G10L 19/04* (2013.01)

(58) Field of Classification Search
None
See application file for complete search history.

(56) References Cited

U.S. PATENT DOCUMENTS 4,811,398 A * 3/1989 Copperi ..... G10L 19/06 375/243
6,574,593 B1 * 6/2003 Gao ..... G10L 19/00 704/222
(Continued)

FOREIGN PATENT DOCUMENTS

EP 0395440 10/1990
RU 2488897 C1 7/2013
(Continued)

OTHER PUBLICATIONS

Office action received for corresponding Canadian Patent Application No. 2959450, dated Dec. 21, 2017, 5 pages.
(Continued)

*Primary Examiner* — Neeraj Sharma
(74) *Attorney, Agent, or Firm* — Alston & Bird LLP

(57) ABSTRACT

A technique for audio encoding is provided. According to an example embodiment, the technique comprises deriving a first quantization error that is descriptive of an error resulting with a non-predictive quantization of an audio parameter of an audio signal segment, deriving a second quantization error that is descriptive of an error resulting with a predictive quantization of said audio parameter of said audio signal segment, determining whether said second quantization error exceeds said first quantization error by at least an adaptive margin that is dependent on the number of consecutive audio signal segments that precede said audio signal segment in which said audio parameter is provided quantized with said predictive quantization, providing said audio parameter of said audio segment quantized with said non-predictive quantization as part of an encoded audio signal at least in case the outcome of said determination is affirmative, and providing otherwise said audio parameter of
(Continued)

said audio segment quantized with said predictive quantization as part of an encoded audio signal.

18 Claims, 6 Drawing Sheets

(56) References Cited

U.S. PATENT DOCUMENTS

| | | | | |
|---|---|---|---|---|
| 6,671,669 | B1 * | 12/2003 | Garudadri | G10L 15/32 704/255 |
| 6,691,092 | B1 * | 2/2004 | Udaya Bhaskar | G10L 19/097 704/205 |
| 6,889,185 | B1 * | 5/2005 | McCree | G10L 19/038 704/219 |
| 7,209,878 | B2 | 4/2007 | Chen | |
| 7,523,032 | B2 * | 4/2009 | Heikkinen | G10L 19/08 704/207 |
| 7,587,314 | B2 * | 9/2009 | Vasilache | G10L 19/24 704/222 |
| 7,746,882 | B2 | 6/2010 | Vedantham et al. | |
| 8,401,843 | B2 | 3/2013 | Eksler et al. | |
| 9,478,224 | B2 * | 10/2016 | Kjoerling | G10L 19/008 |
| 2004/0176951 | A1 * | 9/2004 | Sung | G10L 19/07 704/222 |
| 2008/0180307 | A1 | 7/2008 | Ramo et al. | |
| 2008/0249768 | A1 * | 10/2008 | Ertan | G10L 19/005 704/219 |
| 2010/0153121 | A1 | 6/2010 | Toguri et al. | |
| 2012/0221344 | A1 * | 8/2012 | Yamanashi | G10L 19/0204 704/500 |
| 2014/0236583 | A1 * | 8/2014 | Rajendran | G10L 19/07 704/205 |

FOREIGN PATENT DOCUMENTS

| | | |
|---|---|---|
| WO | 02/35523 A2 | 5/2002 |
| WO | 2012144878 | 10/2012 |

OTHER PUBLICATIONS

International Search Report and Written Opinion received for corresponding Patent Cooperation Treaty Application No. PCT/FI2014/050658, dated May 2, 2015, 10 pages.

"3rd Generation Partnership Project;Technical Specification Group Services and System Aspects;Codec for Enhanced Voice ServicesEVS Codec Detailed Algorithmic Description(Release 12)", 3GPP TS 26.445, V0.1.0, Aug. 2014, pp. 1-18.

"Frame Error Robust Narrow-band and Wideband Embedded Variable Bit-rate Coding of Speech and Audio From 8-32 Kbit/s", Series G: Transmission Systems and Media,Digital Systems and Networks Digital terminal equipment—Coding of voice and audio signals, Recommendation ITU-T G.718, Jun. 2008, 257 Pages.

Office action received for corresponding Russian Patent Application No. 2017108166, dated May 11, 2018, 6 pages of office action and no page of translation available.

Office Action for Canadian Application No. 2,959,450 dated Nov. 8, 2018, 3 pages.

Office Action for Korean Application No. 10-2017-7008309 dated Nov. 21, 2018, 14 pages.

Intention to Grant for European Application No. 14 761 388.9 dated Nov. 15, 2018, 5 pages.

Office action received for corresponding Russian Patent Application No. MX/a/2017/002657, dated Jul. 9, 2018, 3 pages of office action and no page of translation available.

Office Action for U.S. Appl. No. 16/522,868 dated Aug. 28, 2019, 7 pages.

* cited by examiner

AUDIO PARAMETER QUANTIZATION

RELATED APPLICATION

This application was originally filed as PCT Application No. PCT/FI2014/050658 filed Aug. 28, 2014.

TECHNICAL FIELD

The example and non-limiting embodiments of the present invention relate in general to the field of audio coding and more specifically to the field of audio quantization.

BACKGROUND

Audio encoders and decoders are used for a wide variety of applications in communication, multimedia and storage systems. An audio encoder is used for encoding audio signals, like speech, in particular for enabling an efficient transmission or storage of the audio signal, while an audio decoder constructs a synthesized signal based on a received encoded signal. A pair of an audio encoder and an audio decoder is referred to as an audio codec.

When implementing an audio codec, it is thus an aim to save transmission and storage capacity while maintaining a high quality of the synthesized audio signal. Also robustness in respect of transmission errors is important, especially with mobile and voice over internet protocol (VoIP) applications. On the other hand, the complexity of the audio codec is limited by the processing power of the application platform.

A speech codec (including a speech encoder and a speech decoder) may be seen as an audio codec that is specifically tailored for encoding and decoding speech signals. In a typical speech encoder, the input speech signal is processed in segments, which are called frames. Typically the frame length is from 10 to 30 ms, whereas a lookahead segment covering e.g. 5-15 ms in the beginning of the immediately following frame may be available for the coder in addition. The frame length may be fixed (e.g. to 20 ms) or the frame length may be varied from frame to frame. A frame may further be divided into a number of sub frames. For every frame, the speech encoder determines a parametric representation of the input signal. The parameters are quantized and transmitted through a communication channel or stored in a storage medium in a digital form. At the receiving end, the speech decoder constructs synthesized signal based on the received parameters.

The construction of the parameters and the quantization are usually based on codebooks, which contain codevectors optimized for the respective quantization task. In many cases, high compression ratios require highly optimized codebooks. Often the performance of a quantizer can be improved for a given compression ratio by using prediction from one or more previous frames and/or from one or more following frames. Such a quantization will be referred to in the following as predictive quantization, in contrast to a non-predictive quantization which does not rely on any information from preceding frames. A predictive quantization exploits a correlation between a current audio frame and at least one neighboring audio frame for obtaining a prediction for the current frame so that for instance only deviations from this prediction have to be encoded. This requires dedicated codebooks.

Predictive quantization, however, might result in problems in case of errors in transmission or storage. With predictive quantization, a new frame cannot be decoded perfectly, even when received correctly, if at least one preceding frame on which the prediction is based is erroneous or missing. It is therefore useful to apply a non-predictive quantization instead of predictive one once in a while, e.g. at predefined intervals (of fixed number of frames), in order to prevent long runs of error propagation. For such an occasional non-predictive quantization, which is also referred to as "safety-net" quantization, one or more selection criteria may be applied to select one of predictive quantization and non-predictive quantization on frame-by-frame basis to limit the error propagation in case of a frame erasure.

SUMMARY

According to an example embodiment, a method is provided, the method comprising deriving a first quantization error that is descriptive of an error resulting with a non-predictive quantization of an audio parameter of an audio signal segment, deriving a second quantization error that is descriptive of an error resulting with a predictive quantization of said audio parameter of said audio signal segment, determining whether said second quantization error exceeds said first quantization error by at least an adaptive margin that is dependent on the number of consecutive audio signal segments that precede said audio signal segment in which said audio parameter is provided quantized with said predictive quantization, providing said audio parameter of said audio segment quantized with said non-predictive quantization as part of an encoded audio signal at least in case the outcome of said determination is affirmative, and providing otherwise said audio parameter of said audio segment quantized with said predictive quantization as part of an encoded audio signal.

According to another example embodiment, an apparatus is provided, the apparatus comprising a processing component configured to derive a first quantization error that is descriptive of an error resulting with a non-predictive quantization of an audio parameter of an audio signal segment, a processing component configured to derive a second quantization error that is descriptive of an error resulting with a predictive quantization of said audio parameter of said audio signal segment, a processing component configured to determine whether said second quantization error exceeds said first quantization error by at least an adaptive margin that is dependent on the number of consecutive audio signal segments that precede said audio signal segment in which said audio parameter is provided quantized with said predictive quantization, a processing component configured to provide said audio parameter of said audio segment quantized with said non-predictive quantization as part of an encoded audio signal at least in case the outcome of said determination is affirmative, and a processing component configured to provide otherwise said audio parameter of said audio segment quantized with said predictive quantization as part of an encoded audio signal.

According to another example embodiment, an apparatus is provided, the apparatus comprising means for deriving a first quantization error that is descriptive of an error resulting with a non-predictive quantization of an audio parameter of an audio signal segment, means for deriving a second quantization error that is descriptive of an error resulting with a predictive quantization of said audio parameter of said audio signal segment, means for determining whether said second quantization error exceeds said first quantization error by at least an adaptive margin that is dependent on the number of consecutive audio signal segments that precede said audio signal segment in which said audio parameter is provided quantized with said predictive quantization, means for providing said audio parameter of said audio segment quantized with said non-predictive quantization as part of an encoded audio signal at least in case the outcome of said determination is affirmative, and means for providing otherwise said audio parameter of said audio segment quantized with said predictive quantization as part of an encoded audio signal.

According to another example embodiment, a computer program is provided, the computer program comprising computer readable program code configured to cause performing at least the following when said program code is executed on a computing apparatus: deriving a first quantization error that is descriptive of an error resulting with a non-predictive quantization of an audio parameter of an audio signal segment, deriving a second quantization error that is descriptive of an error resulting with a predictive quantization of said audio parameter of said audio signal segment, determining whether said second quantization error exceeds said first quantization error by at least an adaptive margin that is dependent on the number of consecutive audio signal segments that precede said audio signal segment in which said audio parameter is provided quantized with said predictive quantization, providing said audio parameter of said audio segment quantized with said non-predictive quantization as part of an encoded audio signal at least in case the outcome of said determination is affirmative, and providing otherwise said audio parameter of said audio segment quantized with said predictive quantization as part of an encoded audio signal.

The computer program referred to above may be embodied on a volatile or a non-volatile computer-readable record medium, for example as a computer program product comprising the computer program according to above example embodiment stored in said record medium.

The exemplifying embodiments of the invention presented in this patent application are not to be interpreted to pose limitations to the applicability of the appended claims. The verb "to comprise" and its derivatives are used in this patent application as an open limitation that does not exclude the existence of also unrecited features. The features described hereinafter are mutually freely combinable unless explicitly stated otherwise.

Some features of the invention are set forth in the appended claims. Aspects of the invention, however, both as to its construction and its method of operation, together with additional objects and advantages thereof, will be best understood from the following description of some example embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

Figure 1:
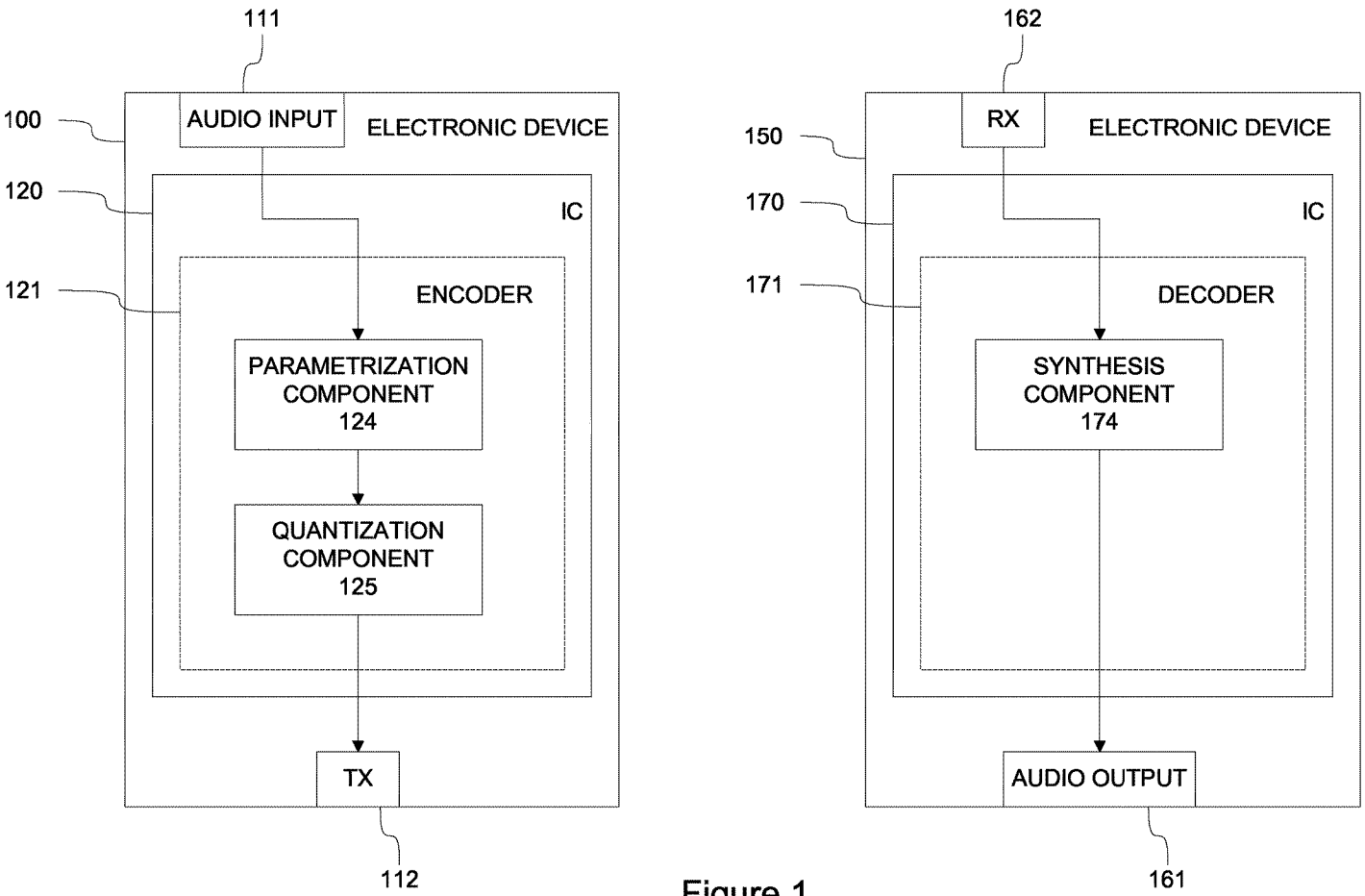
FIG. 1 schematically illustrates some components of a system according to an example embodiment.

Even though the safety-net quantization approaches outlined in the foregoing may be applied to provide an improvement over pure predictive quantization in terms of the overall coding performance with and without errors in storage or transmission, a considerable problem due to the predictive character of the quantization may still remain.

Normally, depending on characteristics of the input audio signal, predictive quantization may provide quantization performance exceeding that of the non-predictive quantization in up to 70 to 90% of the frames. The superior performance of the predictive quantization may be especially pronounced during segments of speech signal that exhibit stationary spectral characteristics (e.g. voiced speech), which may extend over tens of consecutive frames, thereby possibly leading to long streaks of consecutive frames for which predictive quantization is applied.

As an example, one approach for improving the overall performance of the safety-net approach outlined in the foregoing by increasing the usage of the non-predictive quantization includes using a preference gain to favor the non-predictive quantization over the predictive one despite the better quantization performance provided by the predictive quantization. That is, the predictive quantization might be required to outperform the non-predictive one by a fixed predefined margin (or by a fixed predefined factor) in order to the predictive quantization to be selected over the non-predictive one. As an example in this regard, the requirement for selecting the predictive quantization may include that the predictive quantization must be e.g. 1.3 times better in terms of quantization error than the non-predictive quantization (e.g. such that the quantization error resulting with the predictive quantization multiplied by 1.3 must be smaller than the quantization error resulting with the non-predictive quantization for the same frame), thus reducing the usage of predictive quantization. This option results in shortening the streaks of consecutive frames quantized with the predictive quantization (in dependence of the applied value of the fixed predefined margin) and is hence suited to increase the robustness in respect of errors in transmission or storage, while on the other hand it may decrease the quantization performance in case of a clean transmission channel or error-free storage. Moreover, selecting the value for such predefined fixed margin may not be a straightforward task, thereby running a risk of resulting in shorter than desired or longer than desired streaks of consecutive frames quantized with the predictive quantization.

As another example, the performance of the safety-net approach involves setting a maximum value for a streak of consecutive frames quantized with the predictive quantization. While this approach is effective in limiting the maximum length of the error propagation in case of a frame erasure or frame error, it fails to account for differences in the performance improvement provided by the predictive quantization in audio signals of different characteristics. Therefore, also this approach involves a risk of resulting in shorter than desired or longer than desired streaks of consecutive frames quantized with the predictive quantization. Moreover, forced termination of a streak of consecutive predictively quantized frames may occur in a frame where the quantization performance of the predictive quantization is superior to that of the non-predictive quantization, thereby imposing a risk of a serious short-term audio quality degradation.

The present invention proceeds from the consideration that using the safety-net approach to discontinue a streak of predictively quantized frames by forcing a non-predictively quantized frame serves to pre-emptively avoid possible error propagation, while on the other hand the forced discontinuation of the streak of predictively quantized frames, especially in a frame where the performance improvement provided by the predictive quantization is significant, is likely to compromise the overall quantization performance at short term and hence lead to compromised audio quality. It is therefore proposed that the selection criteria applied in selecting between predictive and non-predictive quantization for a given frame is arranged to cause preferring the non-predictive quantization over the predictive quantization by a factor that is increased with increasing length of a streak of consecutive frames for which the predictive quantization has been selected. In parallel, one or more further selection criteria may be evaluated for selecting between predictive and non-predictive quantizations.

Consequently, embodiments of the present invention provides a possibility of increasing the audio coding performance in case of channel errors by contributing towards shortening of extensively long streaks of consecutive frames in which the predictive quantization has been applied while still making use of the superior performance of the predictive quantization as long as the performance clearly exceeds that of the non-predictive quantization. While such an approach may result in increasing the objective average quantization error, the selection criteria can be tailored to guarantee keeping the quantization error at a level that renders any possibly resulting inaccuracy in modeling of the audio signal small enough for the error to be hardly audible or not audible at all.

Spectral distortion (SD) is an example of a commonly applied measure to indicate the amount of quantization error, and SD is also suited for evaluating audibility of a quantization error. It may be assumed, for instance, that if a SD due to a quantization lies below 1 dB, the distortion is typically inaudible by a human hearing. In the safety-net approach this fact may be made use of, for example, by selecting the non-predictive quantization whenever it yields a SD that is below a predefined threshold, e.g. 1 dB. To further illustrate this aspect, in general it is not necessary to quantize a particular audio signal segment e.g. with predictive quantization to obtain for instance a very low SD of 0.5 dB, if the non-predictive quantization of the same audio signal segment results in a SD of 0.9 dB, which is already sufficient from the human hearing point of view. In such a case, although the objective quantization error resulting from the non-predictive quantization is larger for the individual audio signal segment, the resulting quantization error can be still considered inaudible and hence it may be advantageous to select the non-predictive quantization for this particular audio segment to facilitate limiting or preventing propagation of quantization error due to a frame erasure or frame loss: If there were an audio signal segment erasure or loss prior to this audio signal segment, the predictive quantization would perform poorly, but the parameters obtained from a non-predictive quantization could be decoded perfectly. In such an approach, an improvement due to usage of the non-predictive quantization instead of the predictive one becomes audible only for the audio signal segments with one or more errors, while for clear channels there is typically no audible degradation. Consequently, such technique may be applied as part of the safety-net approach to contribute towards sufficient quantization quality in both clean channel conditions and in presence of frame erasures/errors, possibly in parallel with further selection criteria for selection between the predictive and non-predictive quantizations.

As becomes apparent from the description in the foregoing, a suitable error measure that may be compared with a predetermined threshold may thus be related to a spectral distortion over a frequency range between the original audio signal segment and an audio signal segment resulting with a quantization. Such error measure may be calculated for both the predictive quantization and the non-predictive quantization. Calculating the error measure in terms of spectral distortion over the frequency range is also suited, for instance, for immittance spectral frequency (ISF) parameters or line spectral frequency (LSF) parameters belonging to an audio signal segment.

The spectral distortion SD for a respective audio signal segment (e.g. a frame of the audio signal) can be represented by the following equation:

$$SD = \frac{1}{\pi}\int_0^{\pi}\left[\log S(\omega) - \log\hat{S}(\omega)\right]^2 d\omega, \tag{1}$$

where $\hat{S}(\omega)$ and $S(\omega)$ are the spectra of the speech frame with and without quantization, respectively. While this spectral distortion would be, for instance, a particularly exact measure for the codebook and quantization selection of linear predictive coding (LPC) parameters in an audio segment, the computational effort for determining the spectral distortion in accordance with the equation (1) could be reduced by using computationally more straightforward methods.

In the regard, the considered error measure may comprise an error measure that at least approximates the spectral distortion (e.g. according to the equation (1)). Such an error measure may be obtained, for example, by combining weighted errors between a component of the original audio signal segment and a corresponding component of the audio signal segment resulting with the quantization. The error measure may be e.g. a psycho acoustically meaningful error measure, obtained for example by combining weighted mean square errors, where the weighting of errors provides a psycho acoustically meaningful weighting. The expression psycho acoustically meaningful weighting means that those spectral components in an audio signal that are recognized by the human ear are emphasized in comparison to those that are apparently not recognized by the human ear. Such weighting may be provided by a set of weighting factors that may be applied to multiply respective components of the to-be-weighted audio signal segment or respective components of the to-be-weighted audio parameter to form a set of weighted components, which weighted components are then combined (e.g. summed) to form the weighted error measure. Suitable weighting factors for this purpose may be calculated in several ways.

An example of such a psycho acoustically meaningful error may comprise a weighted error, e.g. a weighted mean square error, between original (unquantized) ISF parameters and corresponding quantized ISF parameters. As another example, a psycho acoustically meaningful error may comprise a weighted error, e.g. a weighted mean square error between original (unquantized) LSF parameters and corresponding quantized LSF parameters.

In general, it is to be understood that the considered error measure may be determined based on the entirely quantized audio signal segment or on a partially quantized audio signal segment, for instance based on one or more selected quantized parameters in the respective audio signal segment, e.g. the ISF parameters or the LSF parameters referred to in the foregoing.

FIG. 1 depicts a schematic block diagram of an exemplary system, in which a selection of a predictive or non-predictive quantization in accordance with an embodiment of the invention can be implemented. In this text, the terms non-predictive quantization and safety-net quantization will be used synonymously.

The system illustrated in FIG. 1 comprises a first electronic device 100 and a second electronic device 150. The first electronic device 100 is configured to encode audio data, e.g. for a wideband transmission, and the second electronic device 150 is configured to decode encoded audio data. The first electronic device 100 comprises an audio input component 111, which is linked via a chip 120 to a transmitting component (TX) 112. The audio input component 111 can be for instance a microphone, a microphone array, an interface to another device providing audio data or an interface to a memory or a file system from which audio data can be read.

The chip 120 can be for instance an integrated circuit (IC), which includes circuitry for an audio encoder 121, of which selected functional blocks are illustrated schematically. They include a parameterization component 124 and a quantization component 125. The transmitting component 112 is configured to enable a transmission of data to another device, for example to electronic device 150, via a wired or a wireless link. The encoder 121 or the chip 120 could be seen as an exemplary apparatus according to the invention, and the quantization component as representing corresponding processing components.

The electronic device 150 comprises a receiving component 162, which is linked via a chip 170 to an audio output component 161. The receiving component 162 is configured to enable a reception of data from another device, for example from electronic device 100, via a wired or a wireless link. The chip 170 can be for instance an integrated circuit (IC), which includes circuitry for an audio decoder 171, of which a synthesizing component 174 is illustrated. The audio output component 161 can be for instance a loudspeaker or an interface to another device, to which decoded audio data is to be forwarded.

It is to be understood that the depicted connections of FIG. 1 can be realized via various components not shown therein.

An operation in the system of FIG. 1 will now be described in more detail with references to FIGS. 2 to 5.

Figure 2:
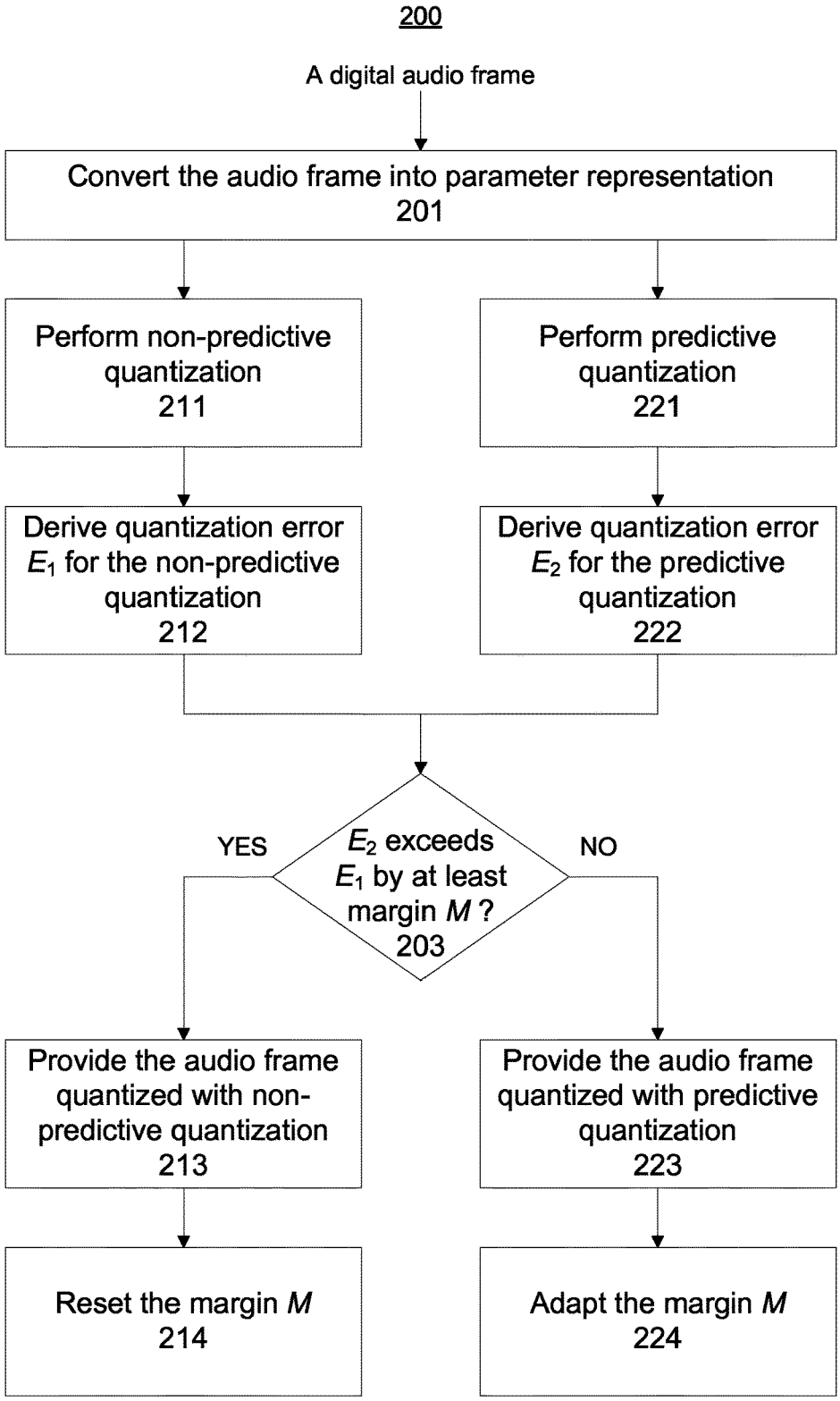
FIG. 2 illustrates a method according to an example embodiment.

FIG. 2 depicts a flow chart illustrating the operation in the audio encoder 121 as steps of an exemplifying method 200. When an audio signal is input to electronic device 100, for example via the audio input component 111, it may be provided to the audio encoder 121 for encoding. Before the audio signal is provided to the audio encoder 121, it may be subjected to some pre-processing. In case an input audio signal is an analog audio signal, for instance, it may first be subjected to an analog-to-digital conversion, etc.

The audio encoder 121 processes the audio signal for instance in audio frames of 20 ms, using a lookahead of 10 ms. Each audio frame constitutes an audio signal segment. The parameterization component 124 first converts the current audio frame into a parameter representation (step 201). The parameter representation for an audio frame of the audio signal may include one or more audio parameters that are descriptive of the audio signal in the frame, whereas an audio parameter may be a scalar (single) parameter or a vector parameter. In the following example, processing according to various embodiments of the present invention is described with references to the LSF and/or ISF parameters in an exemplifying and non-limiting manner.

The quantization component 125 performs on the one hand a non-predictive quantization of one or more parameters of the audio frame (step 211) e.g. by using a non-predictive codebook. The quantization component 125 may perform a quantization of selected parameters only at this stage, while further parameters may be quantized at a later stage (e.g. after selection of one of the predictive and non-predictive quantizations on basis of step 203). In addition, the quantization component 125 derives a value of an error measure that is descriptive of a quantization error $E_1$ resulting with a non-predictive quantization of the one or more audio parameters of the audio frame (step 212). Using a LSF vector comprising the LSF parameters that are descriptive of spectral characteristics of the audio frame as an example, the quantization error $E_1$ may comprise e.g. a mean square error between the LSF parameters quantized with the non-predictive quantization and the original (unquantized) LSF parameters for the audio frame or a weighted mean square error between the LSF parameters quantized with the non-predictive quantization and the original (unquantized) LSF parameters for the audio frame, where the weighting is a psycho acoustically meaningful weighting.

The quantization component 125 performs, on the other hand, a predictive quantization of one or more parameters of the audio frame (step 221) e.g. by using a predictive codebook. The quantization component 125 may perform again a quantization of selected parameters only at this stage (e.g. after selection of one of the predictive and non-predictive quantizations on basis of step 203), while further parameters may be quantized at a later stage. In addition, the quantization component 125 derives a value of an error measure that is descriptive of a quantization error $E_2$ resulting with a predictive quantization of the one or more audio parameters of the audio frame (step 222). As in case of step 212, using the LSF vector as an example of an audio parameter, the quantization error $E_1$ may comprise e.g. a mean square error or a (psycho acoustically) weighted mean square error between the LSF parameters quantized with the predictive quantization and the original (unquantized) LSF parameters for the audio frame.

The predictive quantization may comprise, for example, using any prediction method known in the art to compute a predicted value of an audio parameter (e.g. an LSF vector or a component thereof) in the current audio frame i on basis of the value of the respective audio parameter (e.g. the LSF vector or a component thereof) in one or more frames preceding the audio frame i (e.g. audio frames i−j, where $j=1, \ldots, j_{max}$) and/or on basis of one or more frames following the audio frame i (e.g. audio frames i+k, where $k=1, \ldots, k_{max}$) and using a quantizer to quantize the difference between the original (unquantized) value of the audio parameter in the current audio frame and the predicted value (e.g. on basis of a predictive codebook).

In this regard, the quantization component 125 may apply a linear prediction or a non-linear prediction model for the predictive quantization. As an illustrative and non-limiting example, the prediction in this regard may comprise computing the predicted value of the audio parameter for audio frame i on basis of the value of the respective audio parameter in the closest (e.g. the most recent) preceding audio frame i−1 using one of an autoregressive (AR) prediction model, a moving average (MA) prediction model and an autoregressive moving average (ARMA) prediction model.

Next, the quantization component 125 selects either a non-predictive quantization or a predictive quantization for the current audio frame based on the determined respective quantization errors $E_1$ and $E_2$. In this regard, the quantization component 125 may determine whether the quantization error $E_2$ exceeds the quantization error $E_1$ by at least an adaptive margin M (step 203). The adaptive margin M is dependent on the number of consecutive frames that precede the current audio frame in which the one or more audio parameters are provided quantized with predictive quantization. In other words, the adaptive margin M for the current frame is dependent on the number of frames between the closest preceding audio frame for which the non-predictive quantization has been selected and the current frame. This number of frames may be denoted as the (current) prediction streak length L. Determination of the adaptive margin M is described later in this text.

If the determination in step 203 is affirmative, i.e. in case the quantization error $E_2$ exceeds the quantization error $E_1$ by at least the adaptive margin M, the quantization component 125 provides one or more audio parameters of the current audio frame quantized with the non-predictive quantization (step 213) as part of encoded audio signal. In contrast, if the determination in step 203 is not affirmative, i.e. in case the quantization error $E_2$ fails to exceed the quantization error $E_1$ by at least the adaptive margin M, the quantization component 125 provides one or more audio parameters of the current audio frame quantized with the predictive quantization (step 223) as part of encoded audio signal.

The quantization component 125 may, alternatively or additionally, apply one or more further criteria that may cause selection of the non-predictive quantization and hence the method 200 may be varied, for example, by introducing one or more additional determination or selection steps before or after step 203. As an example in this regard, in a variation of the method 200 the quantization component 125 may determine before step 203 whether the quantization error $E_1$ is smaller than a predefined threshold $E_{th}$, proceed to step 213 in case this determination is affirmative, and proceed to step 203 in case this determination is not affirmative. The threshold $E_{th}$ may be a threshold below which the quantization error $E_1$ may be considered to be inaudible. An appropriate value for the threshold $E_{th}$ is different for different audio parameters and possible different weighting functions applied for weighting the quantization error, and it has to be calculated by trial-and-error off-line. But once a proper value for the threshold $E_{th}$ has been found, the computational complexity increase at the encoder due to the verification in step 302 is minimal. As an example, the threshold $E_{th}$ may be set a value corresponding to a SD in the range from 0.8 to 1.0 dB, e.g. 0.9 dB.

As an example of determining the adaptive margin M in dependence of the prediction streak length L, the margin M may be increased from its initial value $M_0$ by a predefined amount $M_s$ for each audio frame between the current audio frame and the closest preceding audio frame for which the non-predictive quantization has been selected.

As another example of determining the adaptive margin M in dependence of the prediction streak length L, the margin M may be increased from its initial value $M_0$ by a predefined amount $M_s$ for each audio frame in excess of a predefined threshold $L_0$ between the current audio frame and the closest preceding audio frame for which the non-predictive quantization has been selected. In other words, the margin M may be increased from its initial value $M_0$ by a predefined amount $M_s$ $(L-L_0)$ times, provided that L is larger than $L_0$.

As an example, the threshold $L_0$ may be set to a fixed predetermined value, for instance to three (e.g. $L_0=3$), but equally to any other desired value. As another example, the value of the threshold $L_0$ may be set (or adjusted) in dependence of the audio characteristics of the current frame and/or one or more frames immediately preceding the current frame. As a further example, the value of the threshold $L_0$ may be set (or adjusted) in dependence of an encoding mode applied by the audio encoder 121 or by the quantization component 125 for the current frame and/or for one or more frames immediately preceding the current frame.

In the framework of the method 200, the adaptive margin M is either reset to the initial value $M_0$ (step 214) for the next audio frame in case the non-predictive quantization has been selected for the current audio frame or adapted (step 224) by the predefined amount $M_s$ for the next audio frame in case the predictive quantization has been selected for the current audio frame.

As another example, resetting the adaptive margin M (step 214) and/or adaptation of the adaptive margin M (step 224) may take place, on basis of the quantization selected for the closest preceding frame (i.e. the most recent preceding frame), after reception of the next audio frame but before comparison of the quantization errors $E_1$ and $E_2$ (in step 203) instead. As a further example, instead of explicitly resetting the adaptive margin M (step 214) and adjusting the adaptive margin M (step 224), the adaptive margin M may be computed on basis of the prediction streak length L or on basis of the prediction streak length L and the predefined threshold $L_0$, or the adaptive margin M may be obtained from a table accessible by the quantization component 125, which table stores values of the adaptive margin M over a desired range of values of the prediction streak length L. Examples in this regard will be described later in this text.

The initial value $M_0$ for the adaptive margin M may be zero or substantially zero. Alternatively, the initial value $M_0$ for the adaptive margin M may be slightly above zero. Using an initial value $M_0$ slightly above zero serves to ensure preferring the non-predictive quantization over the predictive quantization even when the prediction streak length L is zero (or below the threshold $L_0$). The predefined amount $M_s$ by which the adaptive margin M is to be adjusted for use in the following audio frame may be a small positive value in order to gradually increase the adaptive margin M frame by frame in order to, finally, practically force provision of the one or more audio parameters of an audio frame quantized with the non-predictive quantization as part of encoded audio signal.

Figure 3:
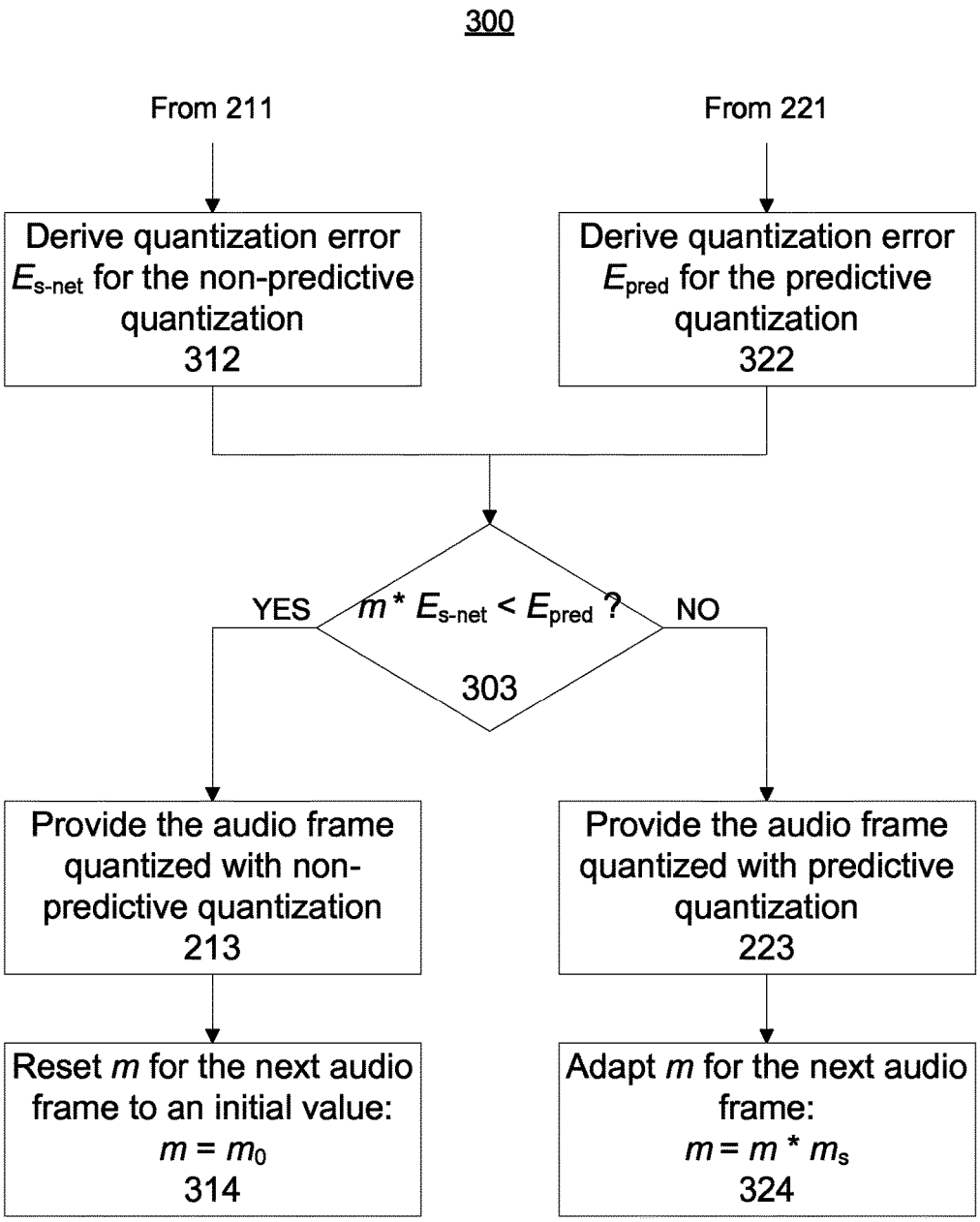
FIG. 3 illustrates a method according to an example embodiment.

FIG. 3 depicts a flow chart illustrating the operation in the audio encoder 121 as steps of an exemplifying method 300. The method 300 serves as an example embodiment within the framework described in the foregoing with references to the method 200. The method 300 shares the steps 201, 211 and 221 with the method 300.

In the method 300, the quantization component 125 may derive a quantization error $E_{s\text{-}net}$ resulting with a non-predictive quantization of the one or more audio parameters of the current audio frame (step 312). As an example, the quantization error $E_{s\text{-}net}$ may comprise a mean square error between the audio parameters quantized with the non-predictive quantization and the respective original (unquantized) audio parameters in the current audio frame. As another example, the quantization error $E_{s\text{-}net}$ may comprise a psycho acoustically relevant error measure, such as a SD or a (psycho acoustically) weighted mean square error between the audio parameters quantized with the non-predictive quantization and the respective original (unquantized) audio parameters in the current audio frame. Using the LSF parameters as an example of one or more audio parameters, the quantization error $E_{s\text{-}net}$ may be provided e.g. as a weighted mean square error between the LSF parameters quantized with the non-predictive quantization and the original LSF parameters for current frame i e.g. in accordance with equation (2).

$$E_{s\text{-}net}^{i}=\Sigma_{p=0}^{N-1}W_p^i(QLsfs_p^i-Lsf_p^i)^2, \tag{2}$$

where N is the length of the quantized vector (e.g. the number of elements in the vector), where $QLsfs_p^i$ is a safety-net quantized optimal LSF vector value p for frame i, where $Lsf_p^i$ is the original, unquantized LSF vector value p for frame i, and where $W_p^i$ is a psycho acoustically relevant weighting vector value p for frame i. In this regard, examples of a suitable weighting vector $W^i$ include the weighting function $w_{end}$ described in section 6.8.2.4 of the ITU-T Recommendation G.718 (June 2008), Frame error robust narrow-band and wideband embedded variable bit-rate coding of speech and audio from 8-32 kbit/s (where the acronym ITU-T stands for the International Telecommunication Union, Telecommunication standardization sector) and the weighting vector $w_{mid}$ described in section 6.8.2.6 of said ITU-T Recommendation G.718.

Continuing description of the method 300, the quantization component 125 may derive a quantization error $E_{pred}$ resulting with a non-predictive quantization of the one or more audio parameters of the current audio frame (step 322). As an example, the quantization error $E_{pred}$ may comprise a mean square error between the audio parameters quantized with the predictive quantization and the respective original (unquantized) audio parameters in the current audio frame. As another example, the quantization error $E_{pred}$ may comprise a psycho acoustically relevant error measure, such as a SD or a (psycho acoustically) weighted mean square error between the audio parameters quantized with the predictive quantization and the respective original (unquantized) audio parameters in the current audio frame. Using, again, the LSF parameters as an example of one or more audio parameters, the quantization error $E_{pred}$ may be provided e.g. as a weighted mean square error between the LSF parameters quantized with the predictive quantization and the original LSF parameters for current frame i e.g. in accordance with equation (3).

$$E_{pred}^{i}=\Sigma_{p=0}^{N-1}W_p^i(QLsfp_p^i-Lsf_p^i)^2, \tag{3}$$

where N is again the length of the quantized vector (e.g. the number of elements in the vector), where $QLsfp_p^i$ is a predictive quantized optimal LSF vector value p for frame i, where $Lsf_p^i$ is again the original, unquantized LSF vector value p for frame i, and where $W_p^i$ is again a psycho acoustically relevant weighting vector value p for frame i., e.g. according to the equation (3). Moreover, the considerations regarding a suitable weighting vector $W^i$ provided n context of the equation (2) are valid also for the equation (3).

Still continuing description of the method 300, the quantization component 125 selects either the predictive or non-predictive quantization based on the quantization errors $E_{s\text{-}net}$ and $E_{pred}$. In particular, the quantization component 125 may determine whether a scaled value of the quantization error $\acute{E}_{s\text{-}net}$ is smaller than the quantization error $E_{pred}$, wherein $\acute{E}_{s\text{-}net}$ is the quantization error $E_{s\text{-}net}$ scaled by the current value of an adaptive scaling factor m, e.g. $\acute{E}_{s_net}=mE_{s\text{-}net}$ (step 303).

If the determination in step 303 is affirmative, i.e. in case the quantization error $E_{s\text{-}net}$ scaled by the current value of an adaptive scaling factor m is smaller than the quantization error $E_{pred}$, the quantization component 125 provides one or more audio parameters of the current audio frame, e.g. at least the LSF parameters, quantized with the non-predictive quantization (step 213) as part of encoded audio signal. In contrast, if the determination in step 303 is not affirmative, i.e. in case the quantization error $E_{s\text{-}net}$ scaled by the current value of an adaptive scaling factor m is not smaller than the quantization error $E_{pred}$, the quantization component 125 provides one or more audio parameters of the current audio frame, e.g. at least the LSF parameters, quantized with the predictive quantization (step 223) as part of encoded audio signal.

Still in the method 300, in case the quantization component 125 has selected the non-predictive quantization for the one or more audio parameters in the current audio frame i, the quantization component 125 may further reset the adaptive scaling factor m for use by the quantization component 125 in the next audio frame i+1 by setting the adaptive scaling factor m to an initial value $m_0$, i.e. set $m=m_0$ (step 314). This corresponds to resetting the adaptive margin M to its initial value $M_0$ in step 214 of the method 200.

In contrast, in case the quantization component 125 has selected the predictive quantization for the one or more audio parameters in the current audio frame i, the quantization component 125 may further adjust the adaptive scaling factor m for use by the quantization component 125 in the next audio frame i+1 by multiplying the scaling factor m by a predefined scaling factor $m_s$, i.e. set $m=m*m_s$ (step 324). This corresponds to adjusting the adaptive margin M by the predefined amount $M_s$ in step 224 of the method 200.

The initial value $m_0$ for the adaptive scaling factor m may be one (e.g. $m_0=1$) or substantially one. As a variation of this approach, the initial value $m_0$ may slightly below one, e.g. in the range from 0.9 to 0.99 in order to ensure preferring the non-predictive quantization over the predictive quantization even when the streak length L is zero, i.e. in a frame immediately following a frame for which the non-predictive quantization has been selected. As an alternative example for ensuring a constant preference for selection of the non-predictive quantization, the condition in step 303 may be rewritten as $$mE_{s\text{-}net}<nE_{pred}, \tag{4}$$

with a predefined scaling factor n set e.g. to a value in the range from 1.01 to 1.1, for example as n=1.05 while the initial value $m_0$ for the scaling factor m is set to one (e.g. $m_0=1$).

The predefined scaling factor $m_s$ may be a positive value smaller than one in order to decrease the adaptive scaling factor m for the next frame i+1. In this regard, the predefined scaling factor $m_s$ may be set to a value selected from a range from 0.7 to 0.95, e.g. $m_s=0.8$. This corresponds to increasing the adaptive margin M frame by frame during a streak of consecutive audio frames for which the predictive quantization has been selected.

Figure 4:
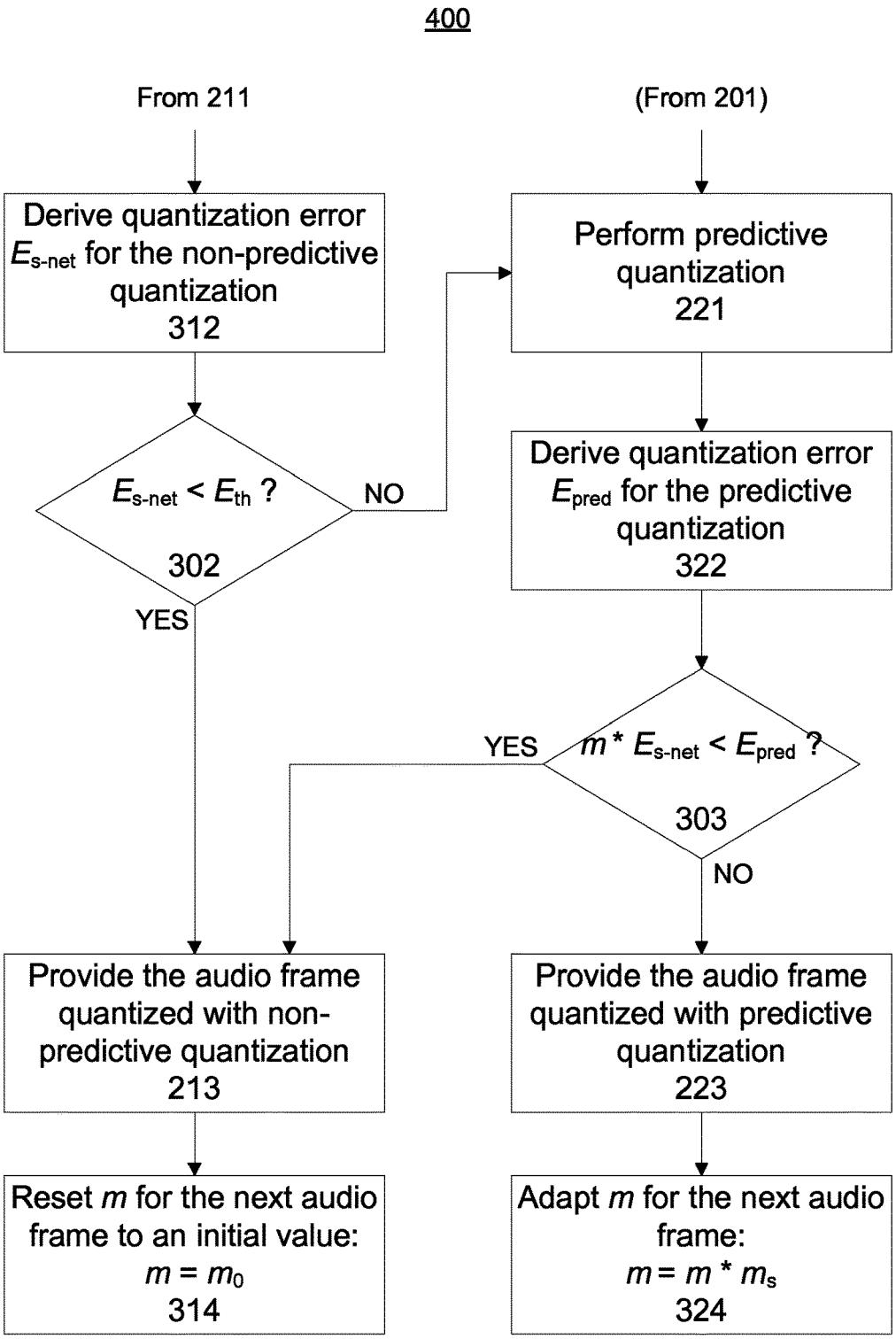
FIG. 4 illustrates a method according to an example embodiment.

FIG. 4 depicts a flow chart illustrating the operation in the audio encoder 121 as steps of an exemplifying method 400. The method 400 is provided as a variation of the method 300 and it serves as another example embodiment within the framework described in the foregoing with references to the method 200. The method 400 shares all steps of the method 300, while an additional verification step 302 is introduced before the determination of step 303.

The step 302 provides a further criterion for selecting the non-predictive quantization for one or more audio parameters of the current audio frame. In particular, the quantization component 125 may select the non-predictive quantization in case the quantization error $E_{s\text{-}net}$ is smaller than a predefined threshold $E_{th}$. In contrast, the quantization component 125 may proceed to determination step 303 in case the quantization error $E_{s\text{-}net}$ is not smaller than a predefined threshold $E_{th}$. In case the verification in step 302 is affirmative, the method 400 proceeds to the predictive quantization of the one or more parameters of the audio frame (step 221) and further to derivation of the quantization error $E_{pred}$ resulting with a non-predictive quantization of the one or more audio parameters of the current audio frame (step 322). Consequently, processing required for the predictive quantization (step 212) and derivation of the quantization error $E_{pred}$ (step 322) may be omitted in case they are not needed to save computational resources.

In a variation of the method 400, steps 221 and 322 may carried out in parallel to steps 211 and 312 before proceeding to step 302. In this variation, in case the verification of step 302 is affirmative, the method 400 proceeds to step 213, whereas in case the verification of step 302 is not affirmative, the method 400 proceeds to step 303.

Along the lines described in the foregoing for the quantization error $E_1$, also in context of the method 400 the considerations regarding the threshold $E_{th}$ provided in context of the method 200 apply: an appropriate value for the threshold $E_{th}$ is different for different audio parameters and possible different weighting functions applied for weighting the quantization error, and it has to be calculated by trial-and-error off-line, and, as an example, the threshold $E_{th}$ may be set a value corresponding to a SD in the range from 0.8 to 1.0 dB, e.g. 0.9 dB.

The method 400 may, optionally, comprise one or more further determination steps for evaluating respective one or more selection rules that may cause selection of the non-predictive quantization. As an example, such determination step(s) may be provided before or after step 302.

Figure 5:
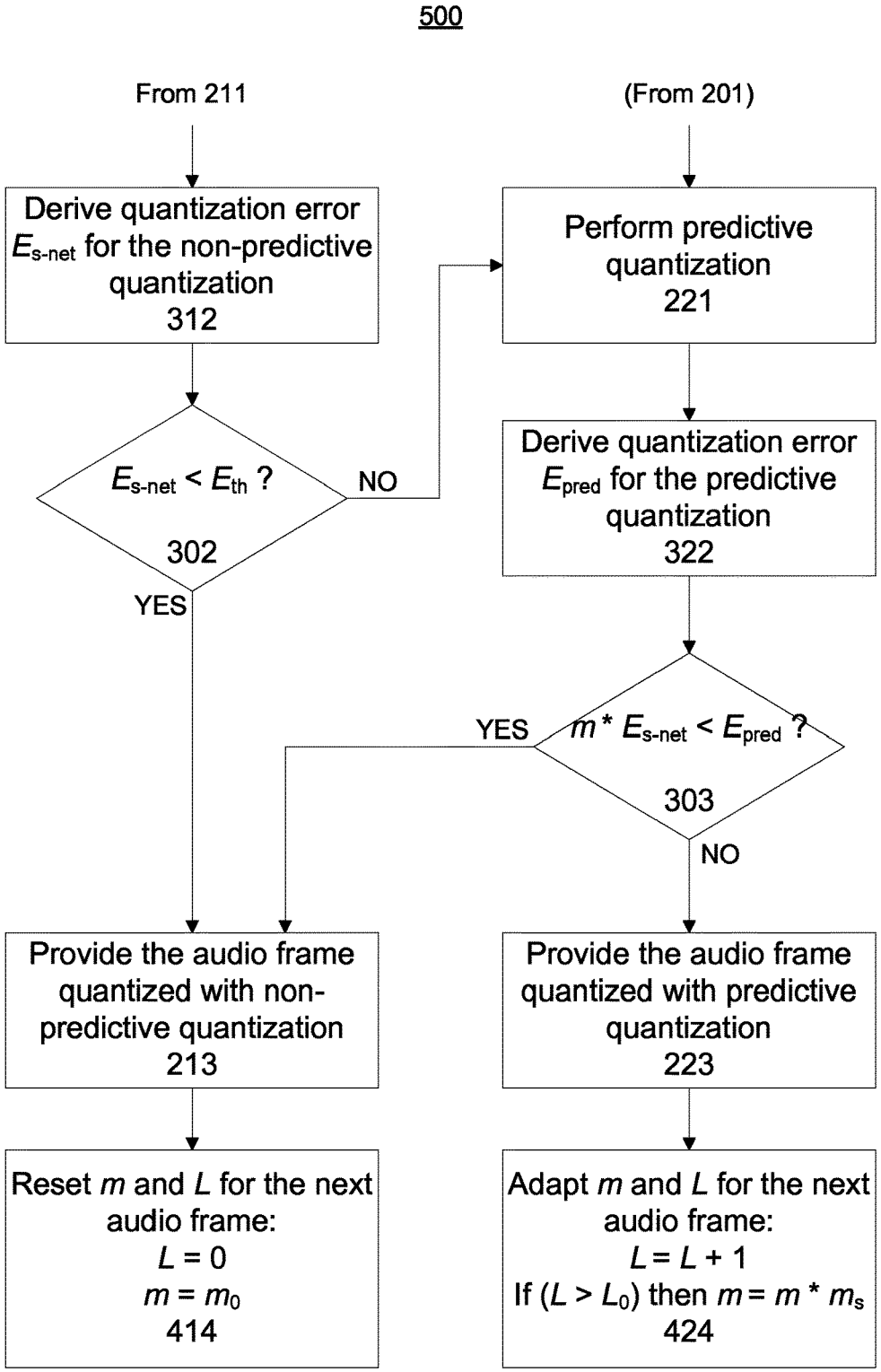
FIG. 5 illustrates a method according to an example embodiment.

FIG. 5 depicts a flow chart illustrating the operation in the audio encoder 121 as steps of an exemplifying method 500. The method 500 is provided as a variation of the method 400 and it serves as another example embodiment within the framework described in the foregoing with references to the method 200. In the method 500, steps 314 and 324 of the method 400 are replaced with respective steps 414 and 424, while the method 500 shares all remaining steps of the method 400. Although described herein as a modification of the method 400, similar modification can be applied to the method 300 as well.

In the method 500, in case the quantization component 125 has selected the non-predictive quantization for the one or more audio parameters in the current audio frame i, the quantization component 125 may further reset the adaptive scaling factor m for use by the quantization component 125 in the next audio frame i+1 by setting the adaptive scaling factor m to an initial value $m_0$ (as described in the foregoing in context of step 314) and further reset a counter indicative of the current prediction streak length L to zero (step 414).

In contrast, in case the quantization component 125 has selected the predictive quantization for the one or more audio parameters in the audio frame i, the quantization component 125 may further increase the counter indicative of the current prediction streak length L by one and, subsequently, adjust the adaptive scaling factor m for use by the quantization component 125 in the next frame i+1 by multiplying the scaling factor m by a predefined scaling factor $m_s$ (as described in the foregoing in context of step 324) provided that the current prediction streak length L exceeds the threshold $L_0$ (step 424). Hence, the adaptive scaling factor m is kept in the initial value $m_0$ until the current prediction streak length L exceeds the threshold $L_0$, whereas the adaptation of the adaptive scaling factor m by the scaling factor $m_s$ takes place for each frame of the prediction streak length in excess of the threshold $L_0$.

In context of the exemplifying methods 300, 400 and 500 described in the foregoing the adaptation of the adaptive scaling factor m is described to take place by either resetting the scaling factor m to the initial value $m_0$ (steps 314, 414) and adjusting the scaling factor m to a new value (steps 324, 424) for processing of the next audio frame in the quantization component 125.

As an alternative approach in this regard, in each of the methods 300, 400 and 500 the above-mentioned resetting and adjusting steps may be omitted and the value of the adaptive scaling factor m may be derived on basis of the current prediction streak length L. For this purpose, the respective one of the methods 300, 400 may further involve keeping track of the current value of the prediction streak length L, e.g. as described in this regard in steps 414 and 424 of the method 500.

As an example in this regard, the adaptive scaling factor m may be computed on basis of the prediction streak length L, e.g. according to equation (5a), or on basis of the prediction streak length L and the predefined threshold $L_0$, e.g. according to equation (5b).

$$m = m_0 m_s^L \tag{5a}$$

$$\begin{cases} m = m_0 & \text{if } L \le L_0 \\ m = m_0 m_s^{(L-L_0)} & \text{otherwise} \end{cases} \tag{5b}$$

As another example in this regard, the adaptive scaling factor m may be obtained by indexing a table accessible by the quantization component 125. Such table may be arranged to store respective value of the adaptive scaling factor m for each value in a predefined range of values of L, e.g. from 0 to $L_{max}$, where $L_{max}$ is the maximum considered (or allowed) length of the predictive streak length L. Computation of the adaptive scaling factor m or accessing the table to find the value of the adaptive scaling factor m may be provided e.g. as an additional step preceding the step 303 (in the methods 300, 400, 500) or preceding the step 302 (in the methods 400, 500).

The provided quantized audio frames may be transmitted by transmitter 112 as a part of encoded audio data in a bit stream together with further information, for instance together with an indication of the employed quantization. Alternatively, the quantized audio frames and the possible indication of the employed quantization may be stored in a memory in the electronic device 100 for subsequent decoding and/or subsequent transmission by the transmitter 112.

At the electronic device 150, the bit stream is received by the receiving component 162 and provided to the decoder 171. In the decoder 171, the synthesizing component 174 constructs a synthesized audio signal based on the quantized parameters in the received bit stream. The reconstructed audio signal may then be provided to the audio output component 161, possibly after some further processing, like a digital-to-analog conversion.

The blocks of FIGS. 2 to 5 could also be understood as schematically represented, separate processing blocks of the quantization component 125.

Figure 6:
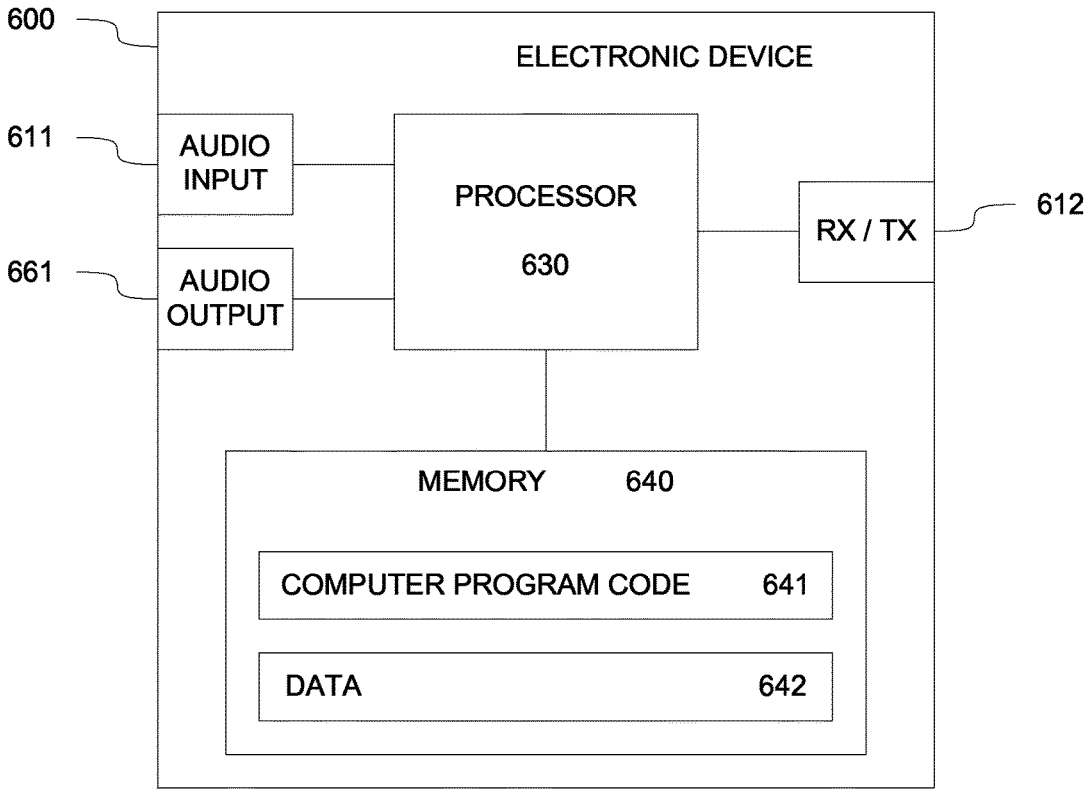
FIG. 6 schematically illustrates some components of an apparatus according to an example embodiment.

FIG. 6 is a schematic block diagram of an exemplary electronic device 600, in which a selection of a predictive or non-predictive quantization in accordance with an embodiment of the invention may be implemented in software.

The electronic device 600 can be for example a mobile phone. It comprises a processor 630 and linked to this processor 630 an audio input component 611, an audio output component 661, a transceiver (RX/TX) 612 and a memory 640. It is to be understood that the indicated connections of the electronic device 600 may be realized via various other elements not shown.

The audio input component 611 can be for instance a microphone, a microphone array or an interface to an audio source. The audio output component 661 can be for instance a loudspeaker. The memory 640 comprises a section 641 for storing computer program code and a section 642 for storing data. The stored computer program code comprises code for encoding audio signals using a selectable quantization and possibly also code for decoding audio signals. The processor 630 is configured to execute available computer program code. As far as the available code is stored in the memory 640, the processor 630 may retrieve the code to this end from section 641 of the memory 640 whenever required. It is to be understood that various other computer program code may be available for execution as well, like an operating program code and program code for various applications.

The stored encoding code or the processor 630 in combination with the memory 640 could also be seen as an exemplary apparatus according to an embodiment of the present invention. The memory 640 storing the encoding code could be seen as an exemplary computer program product according to an embodiment of the present invention.

When a user or e.g. a process running in the electronic device 600 selects a function of the electronic device 600, which requires an encoding of an input audio signal, an application providing this function causes the processor 630 to retrieve the encoding code from the memory 640. Audio signals received via the audio input component 611 are then provided to the processor 630—in the case of received analog audio signals after a conversion to digital audio signals and possible further pre-processing steps required/applied before provision of the audio signal to the processor 630.

The processor 630 executes the retrieved encoding code to encode the digital audio signal. The encoding may correspond to the encoding described above for FIG. 1 with reference to one of FIGS. 2 to 5. The encoding code may hence be seen as a computer program code that causes performing e.g. the encoding described in the foregoing for FIG. 1 with reference to one of FIGS. 2 to 5 when the computer program code is executed by the processor 630 or by another computing apparatus. The encoded audio signal is either stored in the data storage portion 642 of the memory 640 for later use or transmitted by the transceiver 612 to another electronic device.

The processor 630 may further retrieve the decoding code from the memory 640 and execute it to decode an encoded audio signal that is either received via the transceiver 612 or retrieved from the data storage portion 642 of the memory 640. The decoding may correspond to the decoding described above for FIG. 1. The decoded digital audio signal may then be provided to the audio output component 661. In case the audio output component 661 comprises a loudspeaker, the decoded audio signal may for instance be presented to a user via the loudspeaker after a conversion into an analog audio signal and possible further post-processing steps. Alternatively, the decoded digital audio signal could be stored in the data storage portion 642 of the memory 640.

The functions illustrated by the quantization component 125 of FIG. 1 or the functions illustrated by the processor 630 executing program code 641 of FIG. 6 can also be viewed as means for deriving a first quantization error that is descriptive of an error resulting with a non-predictive quantization of an audio parameter of an audio signal segment, means for deriving a second quantization error that is descriptive of an error resulting with a predictive quantization of said audio parameter of said audio signal segment, means for determining whether said second quantization error exceeds said first quantization error by at least an adaptive margin that is dependent on the number of consecutive audio signal segments that precede said audio signal segment in which said audio parameter is provided quantized with said predictive quantization, means for providing said audio parameter of said audio segment quantized with said non-predictive quantization as part of an encoded audio signal at least in case the outcome of said determination is affirmative and means for providing otherwise said audio parameter of said audio segment quantized with said predictive quantization as part of an encoded audio signal. The program codes 641 can also be viewed as comprising such means in the form of functional modules or code components.

While there have been shown and described and pointed out fundamental novel features of the invention as applied to preferred embodiments thereof, it will be understood that various omissions and substitutions and changes in the form and details of the devices and methods described may be made by those skilled in the art without departing from the present invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures.

The invention claimed is:

1. A computer-implemented method for encoding an audio signal by processing a sequence of audio signal segments, the method comprising:

deriving a first quantization error that is descriptive of an error resulting with a non-predictive quantization of an audio parameter of an audio signal segment;

deriving a second quantization error that is descriptive of an error resulting with a predictive quantization of said audio parameter of said audio signal segment;

determining whether said first quantization error multiplied by an adaptive scaling factor is smaller than said second quantization error, said adaptive scaling factor representing an adaptive margin for said audio signal segment, said adaptive margin being dependent on a number of consecutive audio signal segments that precede said audio signal segment in which said audio parameter is provided quantized with said predictive quantization;

providing said audio parameter of said audio segment quantized with said non-predictive quantization as part of an encoded audio signal at least in case the outcome of said determination is affirmative;

providing otherwise said audio parameter of said audio segment quantized with said predictive quantization as part of an encoded audio signal; and causing storage or transmission over a communication channel of the encoded audio signal.

2. The method according to claim 1, wherein said adaptive margin is increased from a predefined initial value by a predefined amount for each audio signal segment between said audio signal segment and a closest preceding audio signal segment in which said audio parameter is provided quantized with said non-predictive quantization.

3. The method according to claim 1, wherein said adaptive margin is increased from a predefined initial value by a predefined amount for each audio signal segment in excess of a predefined threshold between said audio signal segment and a closest preceding audio signal segment in which said audio parameter is provided quantized with said non-predictive quantization.

4. The method according to claim 1, further comprising decreasing said adaptive scaling factor by a predetermined amount in case said audio parameter of said audio segment is provided quantized with said predictive quantization.

5. The method according to claim 1, further comprising decreasing said adaptive scaling factor by a predetermined amount in case said audio parameter of said audio segment is provided quantized with said predictive quantization, and said number of consecutive audio signal segments exceeds a predefined threshold.

6. The method according to claim 1, further comprising resetting said adaptive scaling factor to a predefined initial value in case said audio parameter of said audio segment is provided quantized with said non-predictive quantization.

7. The method according to claim 1, wherein said audio parameter comprises one of an Immittance Spectral Frequency vector and a Line Spectral Frequency vector that is representative of spectral characteristics of said audio segment.

8. The method according to claim 1, wherein said first quantization error is obtained by combining weighted errors between a component of said audio parameter and a corresponding component of said audio parameter resulting with said non-predictive quantization, and said second quantization error is obtained by combining weighted errors between a component of said audio parameter and a corresponding component of said audio parameter resulting with said predictive quantization.

9. An apparatus for encoding an audio signal by processing a sequence of audio signal segments, the apparatus comprising at least one processor; and at least one memory comprising computer program code, the at least one memory and the computer program code configured to, with the at least one processor, cause the apparatus to at least:

derive a first quantization error that is descriptive of an error resulting with a non-predictive quantization of an audio parameter of an audio signal segment;

derive a second quantization error that is descriptive of an error resulting with a predictive quantization of said audio parameter of said audio signal segment;

determine whether said first quantization error multiplied by an adaptive scaling factor is smaller than said second quantization error, said adaptive scaling factor representing an adaptive margin for said audio signal segment, said adaptive margin being dependent on a number of consecutive audio signal segments that precede said audio signal segment in which said audio parameter is provided quantized with said predictive quantization;

provide said audio parameter of said audio segment quantized with said non-predictive quantization as part of an encoded audio signal at least in case the outcome of said determination is affirmative;

provide otherwise said audio parameter of said audio segment quantized with said predictive quantization as part of an encoded audio signal; and cause storage or transmission over a communication channel of the encoded audio signal.

10. The apparatus according to claim 9, wherein the apparatus is further caused to increase said adaptive margin from a predefined initial value by a predefined amount for each audio signal segment between said audio signal segment and a closest preceding audio signal segment in which said audio parameter is provided quantized with said non-predictive quantization.

11. The apparatus according to claim 9, wherein the apparatus is further caused to increase said adaptive margin from a predefined initial value by a predefined amount for each audio signal segment in excess of a predefined threshold between said audio signal segment and a closest preceding audio signal segment in which said audio parameter is provided quantized with said non-predictive quantization.

12. The apparatus according to claim 9, wherein the apparatus is further caused to decrease said adaptive scaling factor by a predetermined amount in case said audio parameter of said audio segment is provided quantized with said predictive quantization.

13. The apparatus according to claim 9, wherein the apparatus is further caused to decrease said adaptive scaling factor by a predetermined amount in case said audio parameter of said audio segment is provided quantized with said predictive quantization, and said number of consecutive audio signal segments exceeds a predefined threshold.

14. The apparatus according to claim 9, further caused to reset said adaptive scaling factor to a predefined initial value in case said audio parameter of said audio segment is provided quantized with said non-predictive quantization.

15. The apparatus according to claim 9, wherein said audio parameter comprises one of an Immittance Spectral Frequency vector and a Line Spectral Frequency vector that is representative of spectral characteristics of said audio segment.

16. The apparatus according to claim 9, further caused to:

compute said first quantization error by combining weighted errors between a component of said audio parameter and a corresponding component of said audio parameter resulting with said non-predictive quantization, and compute said second quantization error by combining weighted errors between a component of said audio parameter and a corresponding component of said audio parameter resulting with said predictive quantization.

17. A computer program product comprising at least one non-transitory computer readable storage medium, the computer readable storage medium comprising a set of instructions which, when executed by one or more processors, causes an apparatus to:

derive a first quantization error that is descriptive of an error resulting with a non-predictive quantization of an audio parameter of an audio signal segment;

derive a second quantization error that is descriptive of an error resulting with a predictive quantization of said audio parameter of said audio signal segment;

determine whether said first quantization error multiplied by an adaptive scaling factor is smaller than said second quantization error, said adaptive scaling factor representing an adaptive margin for said audio signal segment, said adaptive margin being dependent on a number of consecutive audio signal segments that precede said audio signal segment in which said audio parameter is provided quantized with said predictive quantization;

provide said audio parameter of said audio segment quantized with said non-predictive quantization as part of an encoded audio signal at least in case the outcome of said determination is affirmative;

provide otherwise said audio parameter of said audio segment quantized with said predictive quantization as part of an encoded audio signal; and cause storage or transmission over a communication channel of the encoded audio signal.

18. The computer program product according to claim 17, wherein the set of instructions further causes the apparatus to increase said adaptive margin from a predefined initial value by a predefined amount for one of:

each audio signal segment between said audio signal segment and a closest preceding audio signal segment in which said audio parameter is provided quantized with said non-predictive quantization; and each audio signal segment in excess of a predefined threshold between said audio signal segment and a closest preceding audio signal segment in which said audio parameter is provided quantized with said non-predictive quantization.

* * * * *